US005200004A

United States Patent [19]

Verhoeven et al.

[11] Patent Number: 5,200,004

[45] Date of Patent: Apr. 6, 1993

[54] HIGH STRENGTH, LIGHT WEIGHT TI-Y COMPOSITES AND METHOD OF MAKING SAME

[75] Inventors: John D. Verhoeven; Timothy W. Ellis; Alan M. Russell; Lawrence L. Jones, all of Ames, Iowa

[73] Assignee: Iowa State University Research Foundation, Inc., Ames, Iowa

[21] Appl. No.: 808,363

[22] Filed: Dec. 16, 1991

[51] Int. Cl.[5] ..... B22F 7/00

[52] U.S. Cl. ..... 148/527; 148/538; 148/670; 420/416; 428/660

[58] Field of Search ..... 148/527, 538, 670; 420/416; 428/660

[56] References Cited

U.S. PATENT DOCUMENTS 2,810,640 10/1957 Bolkcom et al. ..... 420/416
3,241,930 3/1966 Courney-Pratt et al. ..... 428/655
4,722,869 2/1988 Honda et al. ..... 428/660
4,770,718 9/1988 Verhoeven et al. ..... 148/11.5 P
4,925,741 5/1990 Wong ..... 148/527
5,043,025 8/1991 Verhoeven et al. ..... 148/11.5 P

OTHER PUBLICATIONS

Titanium Technology Present Status and Future Trends, Titanium Development Assoc., Dayton, Ohio H. B. Bomberger, F. H. Froes and P. H. Morton.

*Primary Examiner*—Upendra Roy
*Attorney, Agent, or Firm*—Tilton, Fallon, Lungmus & Chestnut

[57] ABSTRACT

A high strength, light weight "in-situ" Ti-Y composite is produced by deformation processing a cast body having Ti and Y phase components distributed therein. The composite comprises elongated, ribbon-shaped Ti and Y phase components aligned along an axis of the deformed body.

9 Claims, 8 Drawing Sheets

HIGH STRENGTH, LIGHT WEIGHT TI-Y COMPOSITES AND METHOD OF MAKING SAME

CONTRACTUAL ORIGIN OF THE INVENTION

The United States Government has rights in this invention pursuant to Contract No. W-7405-ENG-82 between the U. S. Department of Energy and Iowa State University, Ames, Iowa, which contract grants to the Iowa State University Research Foundation, Inc. the right to apply for this patent.

FIELD OF THE INVENTION

The present invention relates to high strength, light weight metal-metal matrix composites and, more particularly, to deformation processed "in-situ" titanium-yttrium composites exhibiting advantageous strength-to-weight ratios and to methods for their manufacture.

BACKGROUND OF THE INVENTION

A technique known as deformation processing has been developed to improve the strength of Cu-V, Cu-Nb, Cu-Ta, Cu-Fe, Cu-Cr, etc. two phase materials to provide a high strength, high conductivity material for superconducting and other electrical current carrying applications. This technique involves producing a billet of a two phase material (Cu phase and V, Nb, etc. phase) by conventional casting or powder metal processes and then deforming the billet to a significant extent to codeform the two phases present. The amount of deformation is characterized by the parameter, $\eta$, which is defined as the natural logarithm of the ratio of the original area, $A_o$, of the billet to the final area, $A_f$, of the deformed billet; i.e., $\eta = 1n((A_o/A_f)$. As deformation increases, the value of $\eta$ rises from 0 up to as high as 10 to 12. A value of $\eta$ of only 6 represents a very large deformation; e.g., corresponding to reduction of a 1 inch diameter bar to a 0.05 inch diameter wire. Successful deformation of the billet requires that both of the phases present in the billet codeform (deform concurrently) as the cross-sectional area is reduced.

Deformation processing has been most successfully applied to cubic alloy systems, such as the Cu-V, Cu-Nb, Cu-Ta, Cu-Fe, Cu-Cr, etc. systems referred to above as well as to Al-Nb, Al-Ta, and Ni-W systems, wherein one phase has a body centered cubic (bcc) crystal structure and the other phase has a face centered cubic (fcc) crystal structure. In these systems, the bcc phase is observed to change in cross-sectional shape during deformation from a nearly cylindrical morphology to a ribbon morphology which is important for strength attainment purposes. Deformation processing has been less successful in providing strength improvements in cubic alloy systems, such as Cu-Ag, wherein both phases have fcc crystal structures. For example, deformation processed Cu-Ag alloy systems have exhibited a strengthening effect that is less than that observed in the bcc/fcc alloy systems described above. The lesser strengthening effect has been attributed to the failure to develop the desired ribbon morphology in fcc phases present in the Cu-Ag billet upon mechanical deformation thereof.

Titanium alloys have been developed to take advantage of the high mechanical strength and low density of titanium and are in widespread use in the aerospace, transportation, sporting goods, and chemical processing industries. The presence in titanium of an allotropic hexagonal (alpha)→cubic (beta) phase transition at elevated temperatures has allowed a large number of alloys to be developed based upon control of the relative amounts of the two phases through alloying additions (i.e., alpha or beta formers). The microstructure of the most commonly used alloys now in service consists of a mixture of the alpha and the beta phases, together with various intermetallic precipitates formed as a consequence of solution and aging heat treatments to which the alloy is subjected. Examples of near-alpha and alpha plus beta alloys in widespread use include the well known Ti-8%Al-1%Mo-1%V and Ti-6%Al-4%V alloys where the alloyant percentages set forth are in weight percent. These alloys possess relatively high strength and reasonable ductility at room and elevated temperatures; e.g., greater than 850 Mpa ultimate tensile strength and 10–15% elongation at room temperature.

Titanium-based metal matrix composites comprising approximately 20 weight % reinforcement filaments in a titanium or titanium alloy matrix have been developed to this same end. However, processes for making these composites involve pressure infiltration, thixocasting, or attrition milling followed by hot isostatic pressing of the attrited material to achieve full density and thus are quite laborious and expensive.

A titanium-based metal matrix composite exhibiting improved mechanical properties and manufacturable by a simpler, more cost effective process would be welcomed in the art of high strength-to-weight materials for structural and other components in such diverse applications as aerospace, transportation, sporting goods and chemical process components.

SUMMARY OF THE INVENTION

The present invention provides a titanium (Ti)- yttrium (Y) metal matrix composite and method of making the composite by deformation processing of a two phase Ti-Y cast body. The present invention is based on the discovery that the Ti-Y system can be provided as a two-phase cast structure that is deformation processable despite the Ti phase component being present as a hexagonal close packed (hcp) or a body centered cubic (bcc) phase, depending on the temperature of deformation, and the Y phase component being present as a hexagonal close packed (hcp) phase.

In accordance with the method of the invention, a body comprising Ti and Y phase components distributed therein is formed, for example, by solidifying a Ti and Y-containing melt. The body typically comprises, by weight, about 5% to about 60% Y with the remainder consisting essentially of Ti. The body is then deformation processed such that both of the phase components present are mechanically worked to a sufficient degree to impart a ribbon morphology thereto and a desired increased strength level to the composite. The body can be mechanically reduced at room temperature or at elevated temperatures below or above the allotropic transformation temperature of the Ti component; i.e., at a lower elevated temperature where the Ti phase exhibits the hcp structure (alpha phase) or at a higher elevated temperature where the Ti phase has the bcc structure (beta phase) and still achieve the desired ribbon morphology of the phase components as well as the desired improvement in composite strength.

The metal matrix composite of the invention comprises discrete, elongated, ribbon-shaped Ti phase components and Y phase components aligned along an axis of the deformation-processed body. The strength level exhibited by the Ti-Y composite of the invention will depend upon the volumetric proportions of the two components, the amount of mechanical deformation during the deformation processing operation, and any strengthening attributable to work hardening, solid solution hardening, and/or age hardening as a result of the presence of minor alloyants in one or both of the phase components.

DETAILED DESCRIPTION OF THE INVENTION

Figure 1:
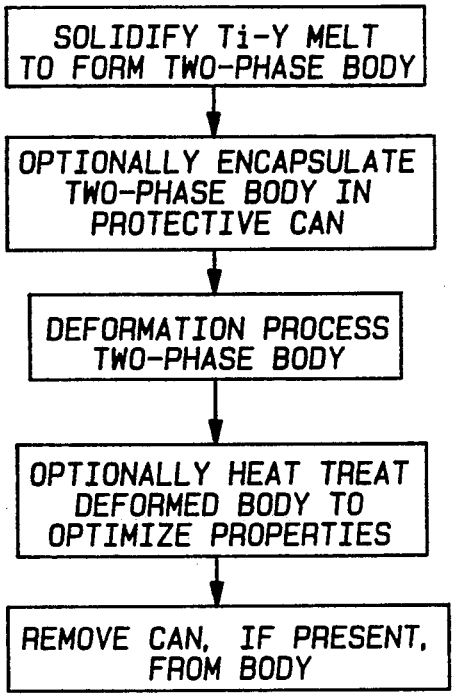
FIG. 1 is a flowsheet illustrating sequential method steps for forming a Ti-Y in-situ composite in accordance with one embodiment of the invention.

Referring to FIG. 1, the various steps involved in practicing one exemplary embodiment of the invention are illustrated. In this embodiment, a composite electrode of Ti and Y powder, sponge, or turnings is fabricated by cold pressing a more or less homogenous mixture of the Ti material and Y material to an appropriate electrode shape. The composite electrode is melted in a conventional consumable arc melting apparatus under an inert gas atmosphere to minimize reaction of the Ti and Y with ambient atmosphere, and the melted electrode material is cast into an underlying water cooled copper mold to provide a desired cast two phase body (e.g.. billet) upon solidification of the melt. Typically, the cast billet has a cylindrical shape for facilitating subsequent deformation processing.

Figure 7:
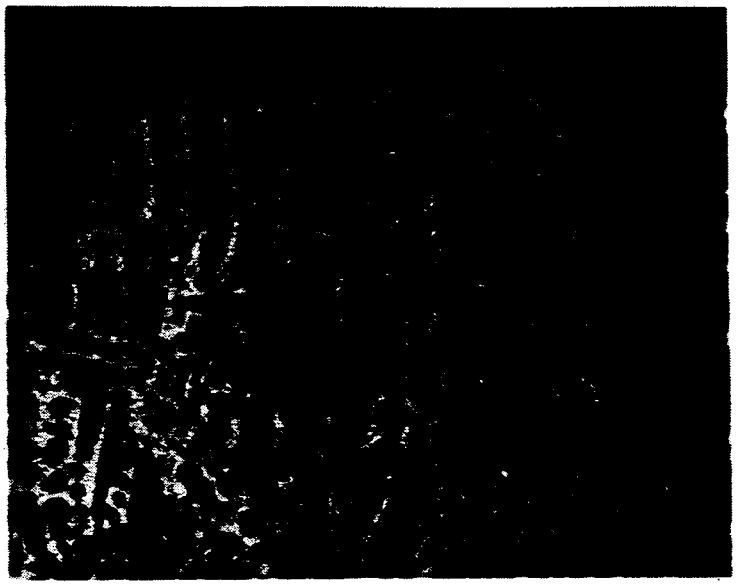
FIG. 7 is a back-scattered scanning electron micrograph at 506× of a transverse section of the as-cast two phase microstructure of a Ti-50 weight % Y composite of the invention.

The cast billet includes a two phase as-cast microstructure comprising Ti phase components (dark phase) and Y phase components (light phase) distributed throughout the billet; see, for example, FIG. 7 illustrating the as-cast microstructure of a 50w/o Ti-50w/o Y (w/o=weight %) composite of Example 1 set forth below. The discrete Ti and Y phase components observed in the as-cast microstructure are in accordance with a known phase diagram for the Ti-Y system illustrated in FIG. 2 (set forth in *Binary Alloy Phase Diagrams*. T. B. Massalski, ASM Publication, Metals Park, Ohio, 1987). As shown in the phase diagram, the Ti phase is present as alpha phase below about 870° C. and as beta phase above that temperature up to the liquidus temperature. The alpha phase exhibits an hcp (hexagonal close packed) crystal structure, whereas the beta phase exhibits a bcc (body centered cubic) crystal structure. The Y phase is present as an hcp alpha phase below and above the 870° C. temperature up to 1440° C.

The cast two phase billets produced by the consumable arc melting/casting technique described above were found to exhibit a sound cast structure not adversely affected by the monotectic reaction (represented by the dashed semi-circular region at the top, center of the phase diagram) that occurs in the Ti-Y system.

Although a consumable arc melting/casting technique is described above and was used in generating the Examples set forth below, the invention is not so limited and may be practiced using plasma arc melting, non-consumable arc melting, VADER melting and other melting/casting techniques where precautions are taken to minimize reaction of Ti and Y with the ambient atmosphere.

The Ti and Y consumable arc electrode described above (constituting an initial charge to be melted and cast) preferably has a composition comprising, by weight, about 5 to about 60%, Y and the balance consisting essentially of Ti. A more preferred electrode composition comprises, by weight, about 15% to about 25% Y and the balance essentially Ti. Minor alloy additions may be made to the charge to improve the strength of the individual Ti and/or Y phases by such mechanisms as work hardening, solid solution hardening, and age hardening. Typical alloyants which may be added to the charge to this end include Al, Sn, V, Cr, Mo, Zr, N, O, and C. The quantity of alloyant added will depend upon the relative solubilities thereof between the Ti and Y phases as well as the type and extent of strengthening required in the composite.

Figure 8:
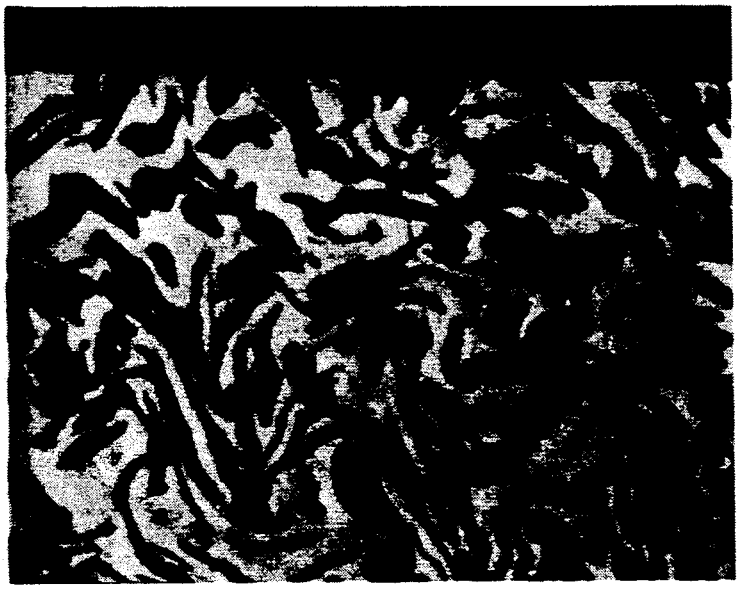
FIG. 8 is a back-scattered scanning electron micrograph at 2610× of a transverse section of the two phase microstructure of the Ti-50 weight % Y composite of FIG. 4 after deformation processing to an $\eta$ of 2.8.
Figure 9:
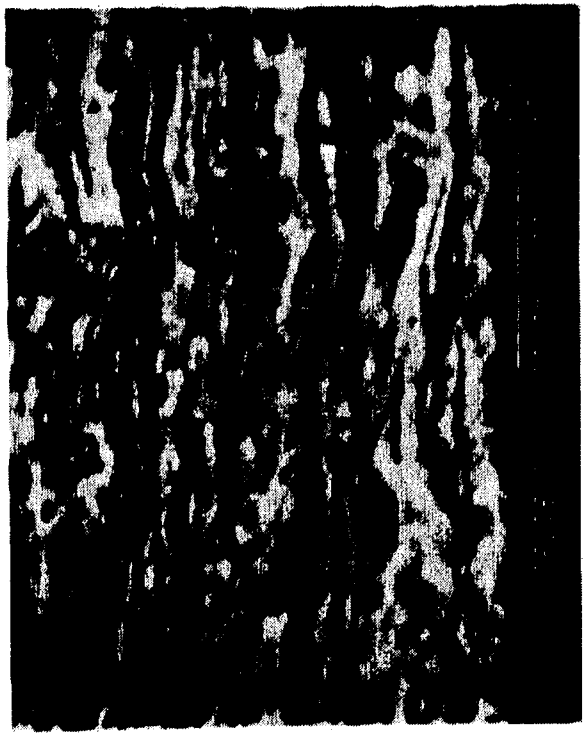
FIG. 9 is a back-scattered scanning election micrograph at 2730× of a longitudinal (axial section of the two phase microstructure of the Ti-50 weight % Y composite after deformation processing to the $\eta$ of 2.8.
Figure 10:
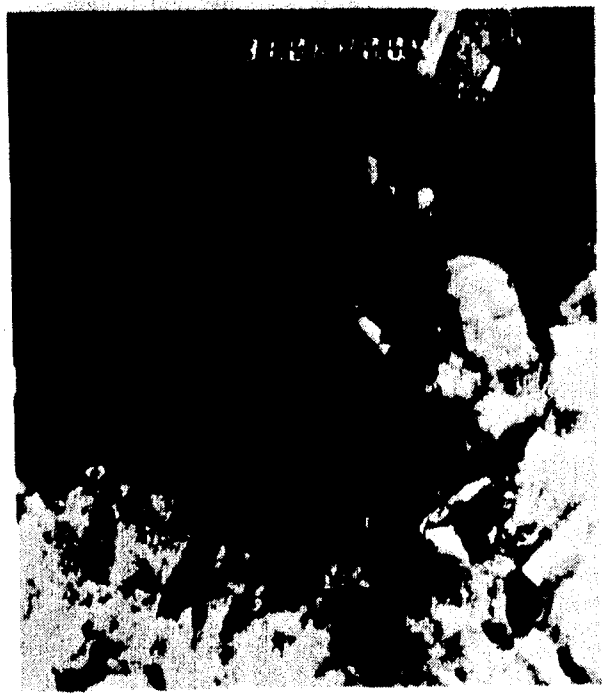
FIG. 10 is a bright field transmission electron micrograph at 31,000× of a transverse section of the two phase microstructure of the Ti-50 weight % Y composite after deformation processing to an $\eta$ of 4.7.

Referring to FIG. 1, the cast, two phase billet is subjected to one or more mechanical deformation (reduction) steps to form an "in-situ" Ti-Y composite. The composite exhibits enhanced strength properties resulting from a deformed microstructure comprising discrete elongated, ribbon-shaped Ti phase components and Y phase components aligned along an axis of the deformed billet; for example, see FIGS. 8–10 illustrating the deformed microstructures of the 50% Ti-50% Y composites of Example 1. Those skilled in the art will appreciate that the weight/volume percentage of the Ti and Y phases will correspond substantially to the original weight/volume percentages in the consumable arc electrode. The observed microstructure of the deformed billet will thus vary with the relative weight or volume percentages of Ti and Y in the billet microstructure.

A large percentage reduction in area is used in the deformation processing operation to form the "in-situ" Ti-Y composite to a desired configuration, such as wire, rod, sheet, and the like, and composite strength level. Typically, the reduction in area is described in terms of the parameter, $\eta$, which is equal to the natural logarithm of the ratio of the cross-sectional area of the billet before reduction ($A_o$) to the cross-sectional area after reduction ($A_f$), i.e., $\eta = ln(A_o/A_f)$. In general, values of the parameter, $\eta$, used in practicing the invention are at least about 2.8, preferably above about 4.5. As will become apparent, such values of $\eta$ yield a composite having room temperature strength of at least about 400 MPa and 600 MPa, respectively. At a higher $\eta$ (e.g., $\eta = 7.6$) the composite will exhibit a room temperature tensile strength of at least about 800 MPa. The value of the parameter, $\eta$, used will depend upon the level of strength desired for the composite. For example, higher values of $\eta$ will result in higher composite strength levels as shown, for example, in FIG. 3 for the 50% Ti-50% Y composites of Example 1.

Figure 2:
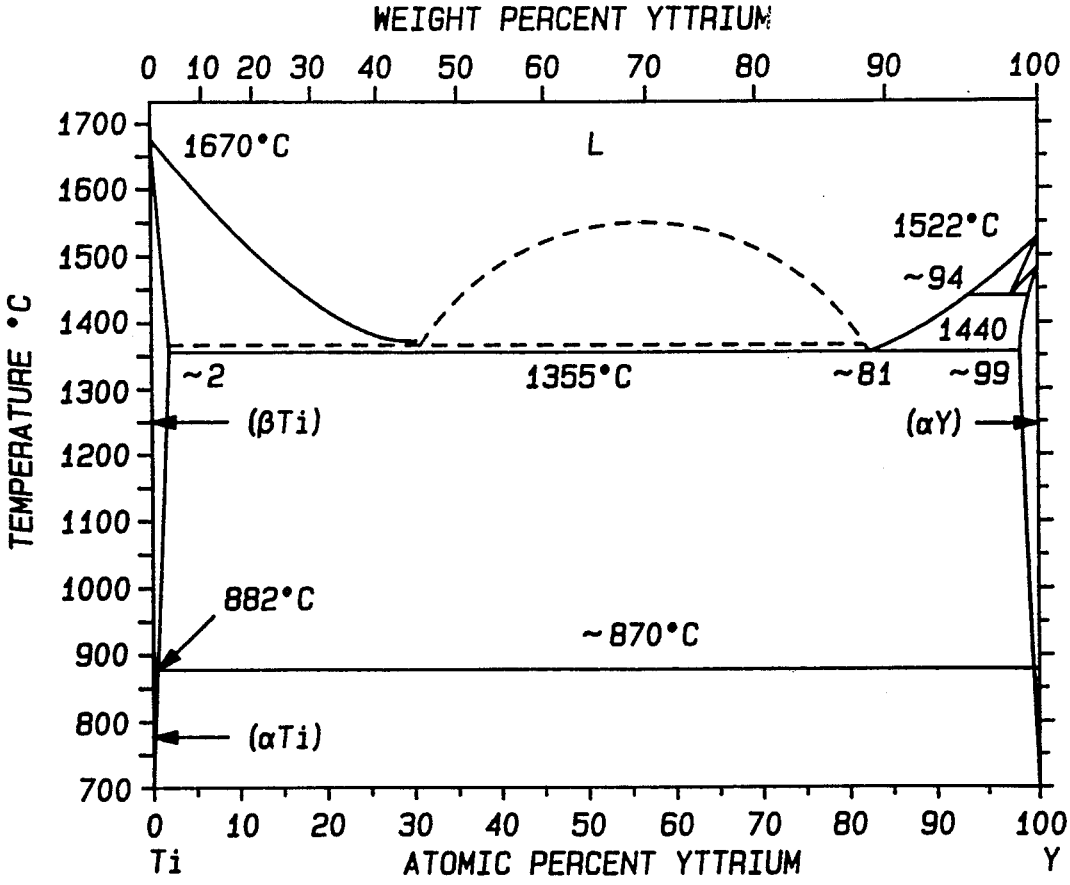
FIG. 2 is a phase diagram for the Ti-Y system.

The mechanical reduction step(s) can be conducted in different temperature regions; e.g., at room temperature or at elevated temperatures below or above the allotropic temperature (about 870° C.) shown in FIG. 2. At room temperature, the Ti and Y phase components can be codeformed (deformed concurrently) with recovery anneals (at 600° C. for 20 minutes) being required after each 20% reduction in area by deformation. Or, the Ti and Y can be codeformed at elevated temperatures between 600° C. and 880° C. without need for the separate recovery anneals. Codeformation of the Ti and Y phases is required in order to develop the desired ribbon morphology of the Ti and Y phases illustrated in FIGS. 8–10 and 12–14. When the deformation step is conducted below about 870° C., the Ti phase will correspond to the hcp (alpha) phase. On the other hand, when the deformation step is conducted above 870° C., the Ti phase will correspond to the bcc (beta) phase. Although the invention is not limited to any particular deformation temperature, certain specific deformation temperatures are described in the Examples set forth below.

The mechanical deformation (reduction) process can be carried out using known mechanical size reduction processes, such as extrusion, swaging, rod rolling, wire drawing, rolling, forging, and like processes (as well as combinations thereof). Certain mechanical reduction techniques are set forth in the Examples set forth below.

Preparatory to deformation processing, the cast billet optionally may be encapsulated in a protective metal (Cu or steel) can or container to avoid reaction of the Ti and Y with ambient air. Following the deformation processing operation, the protective metal can is selectively removed from the deformed composite by, for example, machining, selective dissolution, and other separation techniques. If a protective metal can is not used, descaling operations will be required subsequent to deformation processing to remove an "alpha-case" (surface material having high oxygen and nitrogen contents) from the deformed billet's surface.

The "in-situ" Ti-Y composite typically will not be subjected to any heat treatment following the deformation processing operation unless one or more age hardening alloyants are present in the Ti and/or Y phases. If such age hardening alloyants are present, the "in-situ" composite can be solution annealed in the range of about 600° C. to about 700° C., quenched, and then annealed at a lower temperature effective to achieve the desired age hardening response for optimizing the mechanical properties.

The following Examples are offered to illustrate the invention in further detail without limiting the scope thereof.

EXAMPLE 1

A billet of 50% Ti-50% Y (by weight) was prepared by consumable arc melting a composite electrode in an argon atmosphere and casting the melt into an underlying cylindrical-shaped, water cooled copper mold. The composite electrode was made by arc-melting a mixture of high purity (low oxygen content) elemental Ti and Y powder to rod shape. The cast billet exhibited a two-phase microstructure comprising discrete Ti and Y phases distributed throughout the as-cast microstructure as shown in FIG. 7. The Ti phase is the dark phase whereas the Y phase is the light phase in FIG. 7.

The cast billet was encapsulated and sealed in a low carbon steel tube preparatory to deformation processing. The encapsulated billet was extruded at 880° C. (in the beta phase regime of Ti) to an $\eta$ of 2.8. FIGS. 8 and 9 illustrate the deformed microstructure of the extruded material ($\eta = 2.8$) in transverse cross-section (FIG. 8) and in longitudinal (axial) cross-section (FIG. 9. FIG. 10 illustrates a transverse cross-section of the billet deformed to $\eta = 4.7$ by swaging a portion of the extruded material at room temperature (cold swaging) with recovery anneals performed at 600° C. for 20 minutes after each 20% reduction in area by swaging. This same technique of swaging at room temperature with recovery anneals performed at 600° C. for 20 minutes after each 20% reduction in area was used to deform the material to $\eta = 5.4$ and $\eta = 6.6$.

Portions of the extruded material were also swaged at 725° C. to a $\eta = 3.8$, 4.2 and 4.8.

Figure 3:
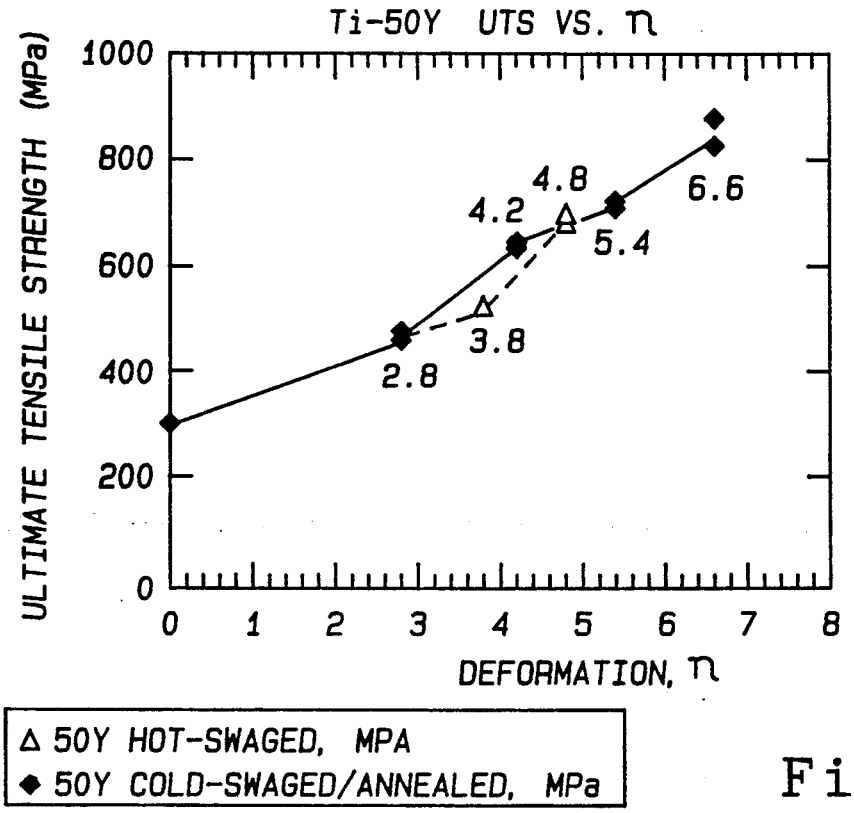
FIG. 3 is a graph of ultimate tensile strength of a Ti-50 weight % Y composite of the invention versus the deformation parameter, $\eta$.
Figure 5:
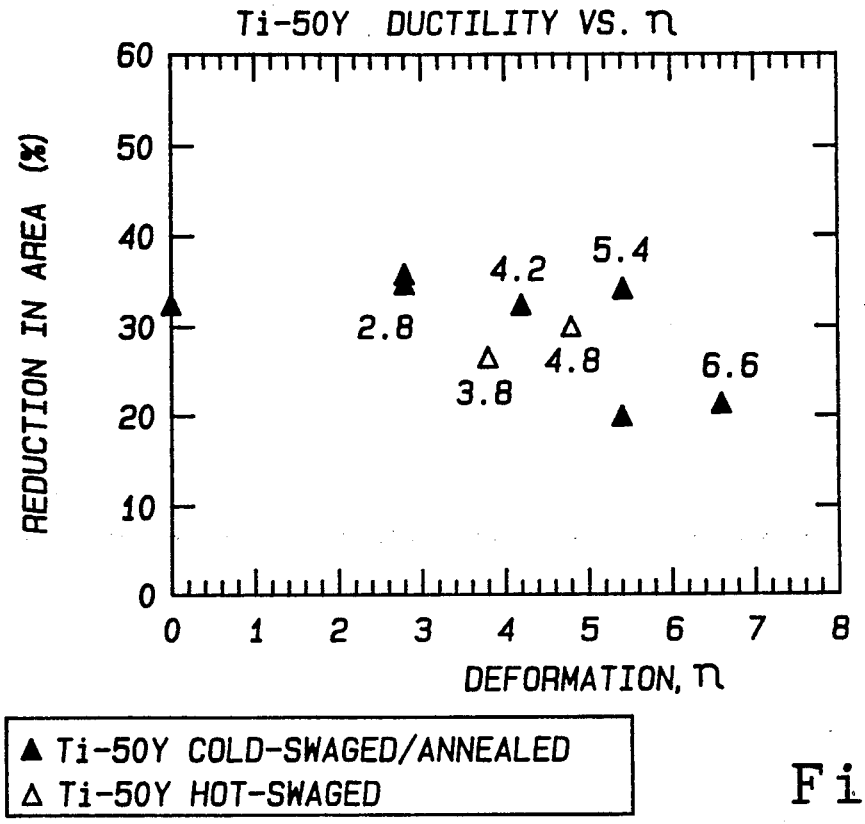
FIG. 5 and 6 are graphs of ductility (measured as percent reduction in area at the point of fracture of a tensile test specimen) of the Ti-50 weight % Y and Ti-20 weight % Y composites of the invention versus the deformation parameter, $\eta$.

It is apparent that the Ti and the Y phases were codeformed to produce an elongated, ribbon-shaped morphology in the resulting deformation processed composite microstructure. The ribbon-shaped phase morphology in the composite microstructure is desirable for achievement of optimum mechanical properties (i.e., tensile strength) in the deformation processed composite. The composites resulting from deformation processing to $\eta = 2.8$, 3.8, 4.2, 4.8, 5.4 and 6.6 were room temperature (RT) tensile tested using ASTM test procedure E8. The results are shown in FIG. 3 and are compared to similar test results obtained from a specimen made from the as-cast billet that was not deformation processed, i.e., $\eta = 0$. An increase in ultimate strength with increases in the value of $\eta$ is apparent. Specimens tested for ductility exhibited adequate ductilities, as shown in FIG. 5, as measured by reduction in area of a fracture specimen. The mechanical properties exhibited by the specimens, especially the specimen deformed to $\eta = 6.6$, are similar to those of known alpha and near alpha titanium alloys, such as Ti-8%Al-1%Mo-1%V. For comparison, the Table below illustrates typical RT mechanical properties for several titanium alloys (*Titanium: A Technical Guide.* Mathew J. Donachie, Jr., ASM International, 1987).

TABLE

| Alloy Type | Tensile Strength Range (MPa) | Elongation, % |
|---|---|---|
| $\alpha$ | 330–860 | 55–40 |
| Near $\alpha$ | 850–1100 | 34–28 |
| $\alpha$–$\beta$ | 690–1280 | 35–19 |
| $\beta$ | 880–1450 | 15–7 |

EXAMPLE 2

Figure 11:
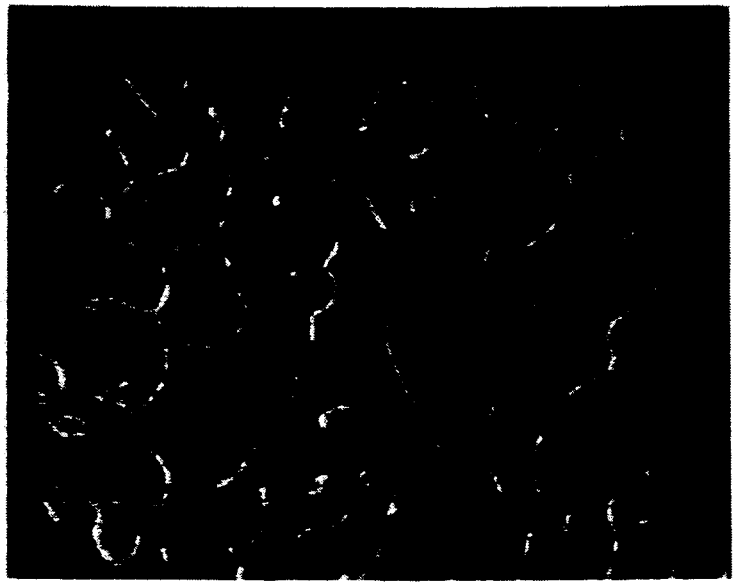
FIG. 11 is a back-scattered scanning electron micrograph at 702× of Ti-20 weight % as-cast.

A billet of 80% Ti-20% Y (by weight) was prepared by arc melting appropriate weights of the high purity elemental Ti and Y powder in an argon atmosphere on an underlying finger-shaped water cooled copper mold. The arc-melted billet exhibited a two phase microstructure comprising discrete Y phase components distributed throughout a Ti matrix as shown in FIG. 11. The Ti phase is the dark phase whereas the Y phase is the light phase in FIG. 11.

The cast billet was encapsulated and sealed in a low carbon steel tube preparatory to deformation processing. The encapsulated billet was swaged at 630° C. to a $\eta=2.0$. The steel tube was removed from the specimen at $\eta=2.0$, and further cold swaging was conducted at room temperature with a recovery anneal (600° C. for 20 minutes) after every 20% reduction in area by swaging to provide $\eta=3.5$, 4.0, 4.9, 6.3 and 7.6. Tensile tests were performed on pieces of the specimen at $\eta=2.0$, 3.5, 4.9, 6.3 and 7.6.

Figure 4:
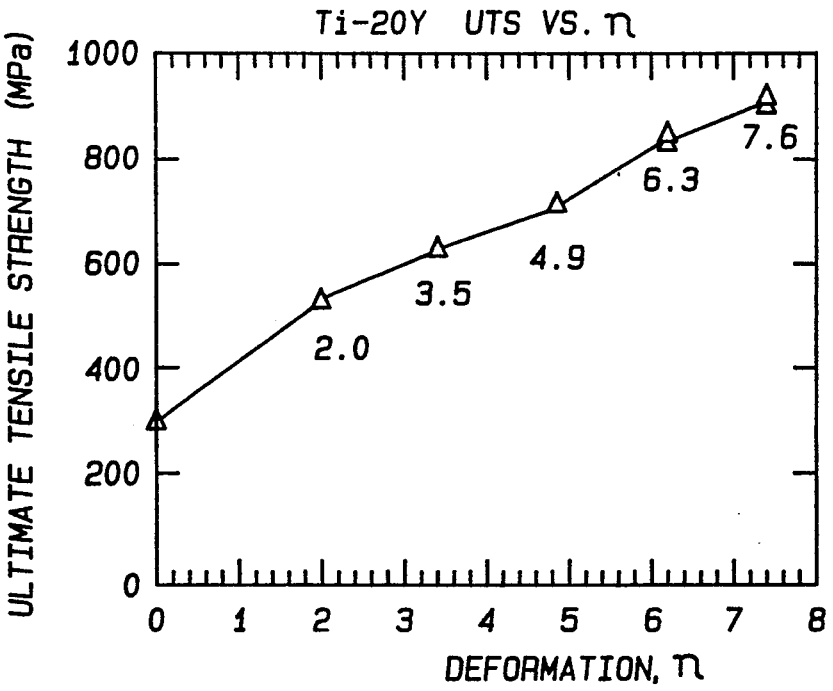
FIG. 4 is a graph of ultimate tensile strength of a Ti-20 weight % Y composite of the invention versus the deformation parameter, $\eta$.
Figure 6:
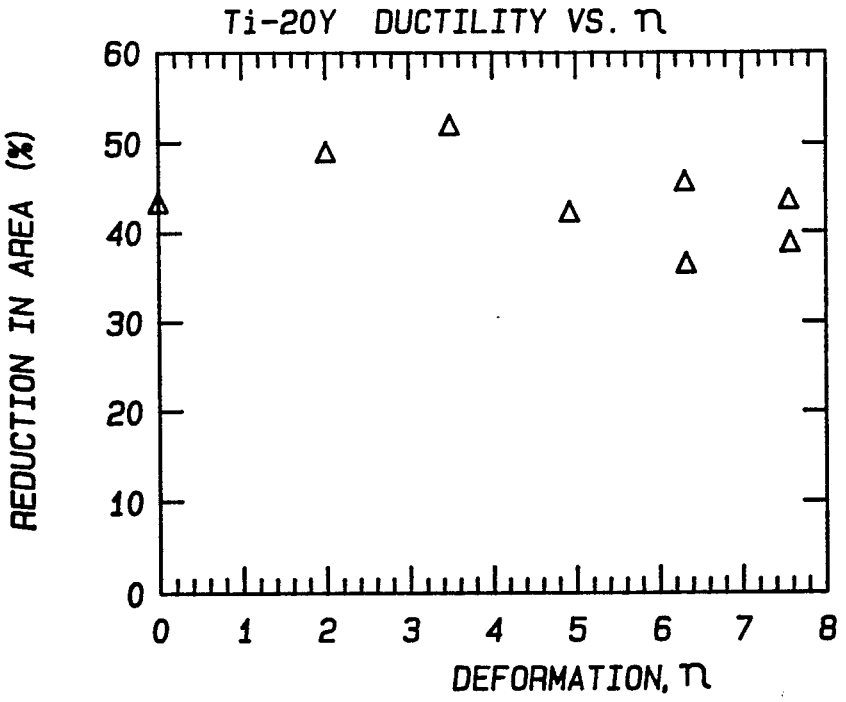
Figure 12:
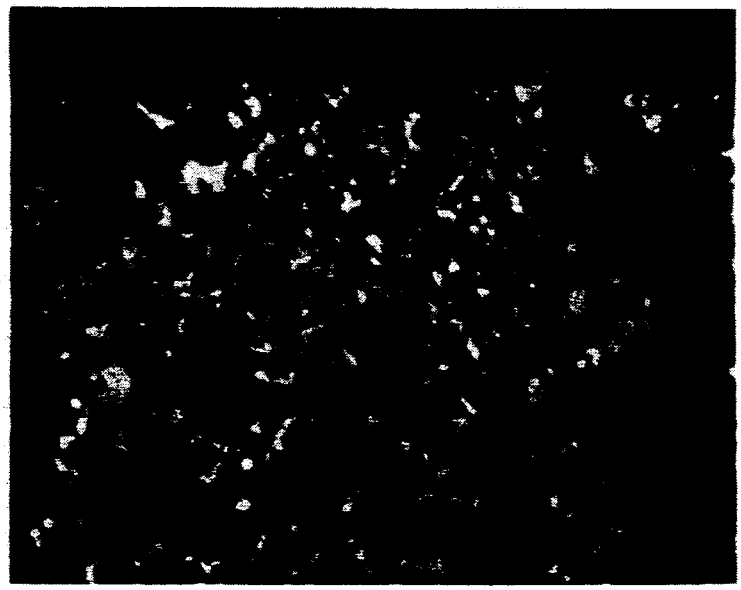
FIG. 12 is a back-scattered scanning electron micrograph (transverse view) at 2580× of a Ti-20 weight % composite after deformation processing to an $\eta=4.0$.
Figure 13:
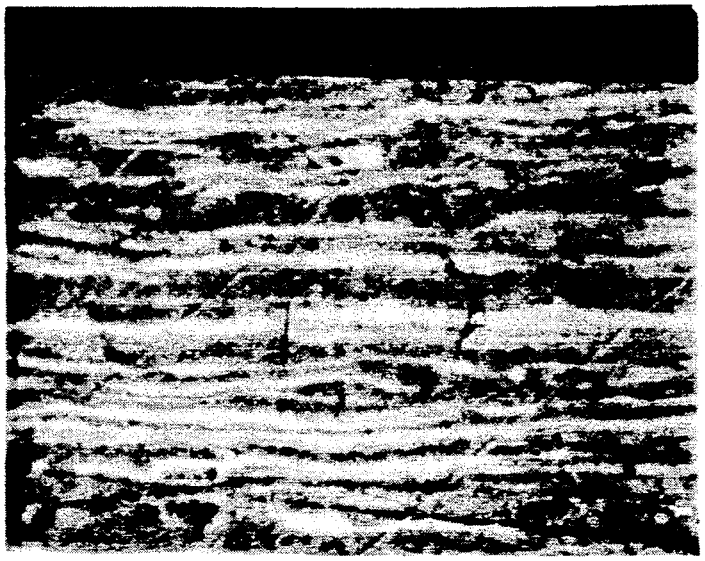
FIG. 13 is a back-scattered scanning electron micrograph (longitudinal view) at 2500× of the Ti-20 weight % Y composite of FIG. 12.
Figure 14A:
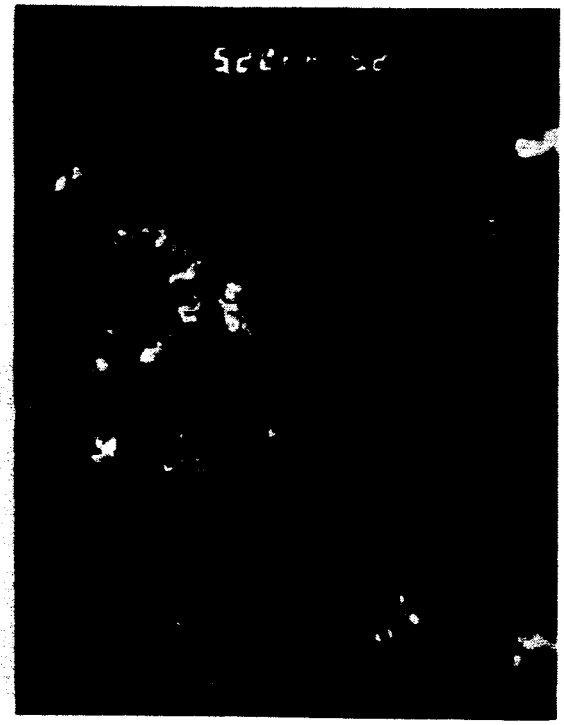
FIGS. 14*a* and 14b are dynamic dark field (FIG. 14*a*) and bright field (FIG. 14*b*) transmission electron micrographs (transverse views) at 52,000× of the same area or region of a Ti-20 weight % Y composite after deformation processing to an $\eta=7.6$.
Figure 14B:
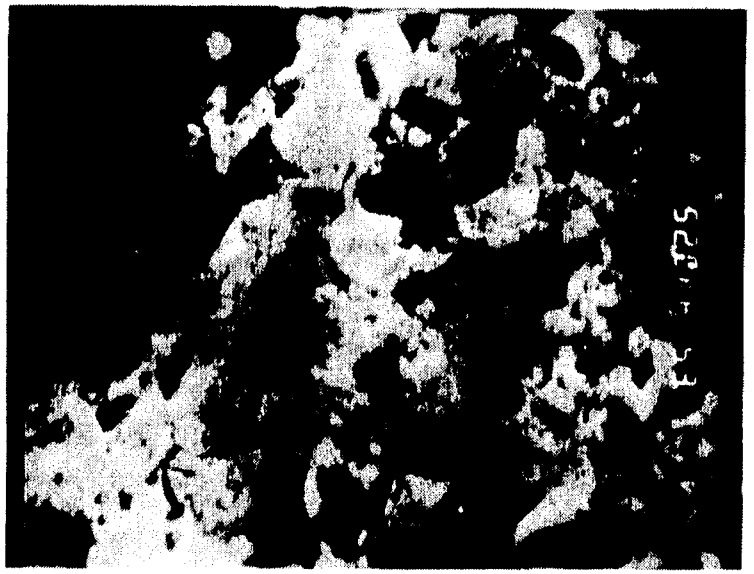

FIGS. 12–13 illustrate the deformed microstructure of the Ti-20 weight % Y billet at $\eta=4.0$ while FIGS. **14*a*–14*b* represent the deformed microstructure at $\eta=7.6$. It is apparent that the Ti and the Y phases were codeformed to produce an elongated, ribbon-shaped morphology in the resulting deformation processed composite microstructure. The ribbon-shaped phase morphology in the composite microstructure is desirable for achievement of optimum mechanical properties in the deformation processed composite. The composites resulting from deformation processing to $\eta=2.0$, 3.5, 4.9, 6.3 and 7.6 were room temperature tensile tested using the test procedure described above, and the results are shown in FIG. 4 and compared to a specimen from an as-cast billet that was not deformation processed; i.e., $\eta=0$. An increase in ultimate strength with increases in the value of $\eta$ is apparent. All specimens tested exhibited adequate ductilities, as shown in FIG. 6**, as measured by reduction in area of a fracture specimen. The mechanical properties exhibited by the specimens, especially the specimen deformed to $\eta=7.6$, compare quite favorably to those of known alpha and near alpha titanium alloys, such as Ti-8%Al-1%Mo-1%V.

While the invention has been described in terms of specific embodiments thereof, it is not intended to be limited thereto but rather only to the extent set forth in the following claims.

I claim:

1. A method of forming a composite of titanium and yttrium, comprising the steps of:

a) forming a body comprising Ti phase components and Y phase components, and b) mechanically deforming the body to form a composite comprising elongated, ribbon-shaped Ti phase components and Y phase components aligned along an axis of the body.

2. The method of claim 1 wherein in step a), the body is formed by solidification of a melt of Ti and Y.

3. The method of claim 1 wherein in step a), the Ti phase component and the Y phase component of the body each has an hcp crystal structure.

4. The method of claim 1 wherein in step b), the body is deformed at room temperature or at an elevated temperature where the Ti phase has an hcp crystal structure.

5. The method of claim 1 Wherein in step b), the body is deformed at an elevated temperature where the Ti phase component has a bcc crystal structure.

6. The method of claim i wherein the body is provided with a composition comprising about 5 to about 60% by weight Y and the balance consisting essentially of Ti.

7. The method of claim 1 wherein in step b), the body is deformed to an $\eta$ of at least about 2.8.

8. The method of claim 6 wherein the body is provided with about 15 to about 25% by weight Y.

9. The method of claim 7 wherein the body is deformed to an $\eta$ above about 4.5.

* * * * *

UNITED STATES PATENT AND TRADEMARK OFFICE

CERTIFICATE OF CORRECTION

PATENT NO. : 5 200 004

DATED : April 6, 1993

INVENTOR(S) : John D. VERHOEVEN, et al

It is certified that error appears in the above-identified patent and that said Letters Patent is hereby corrected as shown below:

On the title page, item [54] and column 1, lines 1 and 2, the title should read --METHOD OF FORMING HIGH STRENGTH, LIGHT WEIGHT MORPHOLOGICALLY ALIGNED COMPOSITE OF Ti-Y--.

Column 8, line 31; replace "Wherein" with ---wherein---.
line 34; replace "claim i" with ---Claim 1---.

Signed and Sealed this

Fourteenth Day of December, 1993

Bruce Lehman

*Attest:*

BRUCE LEHMAN

*Attesting Officer*

*Commissioner of Patents and Trademarks*